US005580046A

United States Patent [19]

Beaufort et al.

[11] Patent Number: 5,580,046

[45] Date of Patent: Dec. 3, 1996

[54] SELECTIVE EJECTION OF SENSED PAPER JAMS IN SINGLE SHEET PAPER PROCESSING EQUIPMENT

[75] Inventors: Richard F. Beaufort, Boise; Jerry Y. Chung, Meridian, both of Id.

[73] Assignee: Hewlett-Packard Company, Palo Alto, Calif.

[21] Appl. No.: 381,371

[22] Filed: Jan. 31, 1995

[51] Int. Cl.[6] ..... B65H 5/22

[52] U.S. Cl. ..... 271/3.16; 271/3.17; 271/4.02; 271/4.03; 271/10.02; 271/10.03; 271/110; 271/259; 271/265.02

[58] Field of Search ..... 271/110, 3.16, 271/3.17, 4.02, 4.03, 10.02, 10.03, 259, 258.03, 258.02, 265.01, 265.02

[56] References Cited

U.S. PATENT DOCUMENTS 3,948,510 4/1976 Iwamoto et al. ..... 271/258.03

5,156,385 10/1992 Muto et al. ..... 271/110 X 5,464,204 11/1995 Suzuki ..... 271/110

FOREIGN PATENT DOCUMENTS 3259831 11/1991 Japan ..... 271/110

*Primary Examiner*—David H. Bollinger

[57] ABSTRACT

Paper processing equipment such as a laser printer uses a plurality of sensors to detect the presence of paper in the paper path of the equipment. In order to provide an appropriate response to different types of malfunctions, a determination of the type of malfunction is made, and in appropriate cases, an attempt is made to self-clear the malfunction. In the case of a paper size error resulting from long size sheets being provided without a corresponding software request, the printer senses a time delay resulting from paper passage of an initial sheet. Pick of a second sheet is delayed for a time period corresponding to long size sheet passage and picks of subsequent sheets are delayed only if the sensed time delay corresponds to the longer length. This paper length information is further used to provide information regarding proper discharge of sheets from the printer.

13 Claims, 4 Drawing Sheets

SELECTIVE EJECTION OF SENSED PAPER JAMS IN SINGLE SHEET PAPER PROCESSING EQUIPMENT

CROSS-REFERENCE TO RELATED APPLICATION

This application shares common subject matter with U.S. patent application Ser. No. 08/381,382, for Input Paper Sensor for Single Sheet Paper Processing Equipment, commonly assigned, and filed on an even date herewith. The disclosure material of said application is incorporated by reference.

FIELD OF THE INVENTION

This invention relates to electrophotographic printing, such as used on laser printers. More particularly, the invention relates to controlling operation of electrophotographic equipment or other paper processing equipment in response to the sensed improper movement of paper.

BACKGROUND OF THE INVENTION

This invention relates to paper processing wherein individual sheets of paper or other media are separated from a stack of sheets and further processed. This type of operation is performed by electrophotographic equipment, as well as a myriad of other paper processing equipment. The processing includes the equipment manipulating or handling the paper in order to move the paper along a paper path. This invention can be used in conjunction with a wide variety of paper processing equipment, but was developed for use with electrophotographic equipment such as laser printers. The invention will be described in its application to electrophotography, it being understood that it also has applicability to other types of paper processing equipment.

Regardless of the particular configuration of the paper processing equipment, many have in common a paper pick, followed by a primary series of paper processing operations. The primary series of paper processing operations in the electrophotographic equipment, including the laser printer of the preferred embodiment is the imager station and fuser stations. This includes the laser printer of the preferred embodiment of this invention.

In electrophotographic printing, individual sheets of paper are taken from a stack of paper in a paper supply and a toner image, corresponding to a pattern of electrostatic charges, is applied to the paper. The removal of an individual sheet of paper from the supply is referred to as a "pick."

In the Assignee's Laser Jet printers, such as the Assignee's Laser Jet II-P™ printer, a pick is accomplished by a roller having an asymmetric profile, called a "D roller," rotating past a fixed pad. The D roller has a higher coefficient of friction with paper than the fixed pad and is spaced from the fixed pad so that only a single sheet of paper normally is moved by the rotation of the D roller. This generally accomplishes the desired pick of a single sheet of paper which is thereby fed to the electrophotographic imager, and subsequently ejected as a printed page.

An alternate technique for accomplishing a pick includes sliding a sheet from a stack of sheets in order to cause the top sheet to buckle. A corner separator is used to retrieve the buckled sheet, which is then fed to the electrophotographic imager and subsequently ejected as a printed page. This technique is used in the Assignee's Laser Jet 4L™ printer.

After the pick, an image is transferred to the paper at an imager, which may be a photoreceptor or other suitable equipment. The sheet is then further processed, usually passing a fuser station to a discharge tray. Additional paper processing may be performed, such as providing a dryer station (used in liquid imaging systems) and a discharge handler such as a paper collator. We use the term, "discharge" to refer to output or ejection of the paper, and such use is not a reference to electrostatic charge of the imager.

In the event of a sensed malfunction, a display on the printer indicates that the malfunction has occurred. The usual procedure requires the operator to investigate and remedy the malfunction, and press a "continue" or "operational reset" button. If the malfunction is a true paper jam, the equipment is partially opened, the wrinkled paper is removed from the paper path. Thereafter, the equipment is closed and the normal operation is continued upon pressing the button. On the other hand, the malfunction may be an empty paper supply. This of course does not require that paper be removed, but merely that the paper supply be replenished.

Paper jams can generate significant customer problems in laser printers. Most of the difficulties involve fuser jams, legal size paper timing malfunctions, Pick-up Delay jams (or no-pick jams), Pick Stationary jams, Delivery Stationary jams, and Initial Residure jams.

In a Pick-up Delay jam (or no-pick jam), the media does not reach a registration sensor within the required time after the start of pick-up. A Pick Stationary jam is the result of the trailing edge of a sheet of paper not reaching the registration position within the required time after the pass of the leading edge of the paper. This means that the time from sensing the leading edge to sensing the trailing edge at the registration position is excessive.

A Delivery Stationary jam is the result of a delivery or forward sensor, located at an output of the imager, failing to detect a sheet of paper in the required time after the output of a Vertical Sync signal. The Vertical Sync signal is merely a reference to the start timing of a print cycle, so the Delivery Stationary jam is an indication that a picked sheet does not make it to the forward sensor after being sensed at the output of the pick mechanism.

The terminology, "Initial Residure," refers to media being resident in the equipment at locations other than the paper supply. In an Initial Residure jam, the delivery sensor or registration sensor detects or senses the media at a required time after power-on. This is an indication that the sensor is blocked, for example, by a sheet of paper in the paper path.

The response to a paper path malfunction has typically been to discontinue operation of the printer until the jam could be cleared by the operator. In reality, there are different ideal responses to different types of paper jams. If the jam is one of slow feed, then if the paper is eventually picked up by the pick mechanism, then the malfunction has self corrected and the printer should continue operating. If the malfunction is the result of an accordion jam at the fuser station (near the output of the printer), the continued operation of the printer's paper processing mechanism will probably make the jam worse. Likewise, if the malfunction is the result of a paper wrap at the fuser station, the continued operation of the printer's paper processing mechanism is also not advantageous.

It has been noted that malfunctions in the paper path which are sensed at the output of the pick mechanism are not likely to become significantly more difficult to clear, even if the paper processing mechanism is permitted to remain in operation and the jam is not corrected. As an example, an accordion jam at the output of the pick mechanism would probably not be self-clearing, but continued operation of the paper processing mechanism would not make the jam worse, unless a subsequent sheet is picked. It is likely that permitting the paper processing mechanism to continue operating would merely further bunch the paper and make it easier to extract from the printer. In any case, paper jams at the input of the printer tend to be easiest to manually clear because of their accessibility.

Some printers simultaneously process multiple sheets of paper by effecting a pick operation prior to the ejection of a preceding sheet. Therefore, while a pick operation is being attempted, the preceding sheet may be passing through the fuser station and being processed at the paper discharge portion or output of the printer. If the pick operation is unsuccessful, then having the printer stop when the malfunction is detected will cause a malfunction in printing the preceding sheet. This causes a failed print result on the first sheet, perhaps with unfused toner remaining on the first sheet.

It would be advantageous if the printer were programmed to determine what the most appropriate sequence of operations should be in response to particular paper path malfunctions. In particular, it would be advantageous if the printer could make a determination as to whether the appropriate response to a sensed malfunction is to immediately stop, ignore the malfunction, or continue operation for enough time to clear any remaining sheets and attempt to clear the jam. For similar reasons, it would be advantageous if, in response to a sensed malfunction, a printer did not stop in circumstances which are likely to leave paper in the fuser.

A common error occurs when paper length is used to determine correct function. A common change of paper size is between a letter size sheet and a long size sheet. Typical changes between sizes are between letter size such as A-4 (21.0×29.7 cm) or 8½×11 letter (21.59×27.94 cm) and size such as B4 (25.7×36.4 cm), U.S. 8½×14 legal (21.59×35.56 cm) or oficio (21.59×33.02, used primarily in Italy). These size changes could be either inadvertent as a result of the wrong size sheet inserted into the printer's paper supply, but it is possible that the user intends to use the size paper which is in the tray but has not inserted the software commands for the paper size into the print command of the user's program. As a practical matter, the most common paper size error which affects paper processing is between 8½×11 letter and U.S. 8½14 legal, or between A-4 and U.S. 8½×14 legal. Paper size errors between A-4 and 8½×11 letter are also common, but involve only a 2 cm length discrepancy.

If the printer expects a shorter paper size than is actually loaded into the paper supply, then the trailing edge of the sheets will clear the various portions of the printer later than expected. It is therefore possible that a subsequent pick in a multiple series of sequential pick operations could result in the pages overlapping. This means that in order to ignore paper size errors, the paper processing mechanism must delay printing sequential sheets until enough time has passed for the longest expected sheet to pass. This slows operation of the printer significantly more than if the timing of sequential picks is made to accommodate a narrow range of paper sizes.

The detection of different paper positions usually can be accomplished by sensors at several positions along the paper path. Thus, if the paper size is wrong, a paper size malfunction is detected.

The result of a paper size error is that the printer reports a malfunction. In some cases this is desirable because the wrong size paper is in fact being used, but in other cases it is desirable that the error be ignored. Again, it is advantageous to permit the sheet to proceed to discharge (eject) so as not to stop at the fuser station or otherwise require clearing of the printer. If the paper size error is used to stop the equipment and the user wishes to continue with the "wrong" size paper, the user may have to repeatedly restart the printer for subsequent sheets of paper in a print job.

In other cases, the receipt of a "wrong" size paper error is merely one of improper programming or the result of no page size command being provided either directly to the printer or to the printer through software commands. There are still other cases in which the operator will deliberately wish to use the "wrong" size paper. An example of this is the case in which a document is prepared for printing on A-4 paper, but is to be initially printed on 8½×11 letter (21.59×27.94 cm) paper, using the A-4 formatting. Since page size is also used to determine the timing of successive picks, it is important that the printer accommodate changes in paper size even though the user may otherwise wish to permit printing on the "wrong" size paper.

In a few cases, a size error results from a default paper size being different from the actual common type of paper. As an example, if the common paper is A-4 and the default paper size is 8½×11 letter, then the paper size error would occur each time the software print command does not have the paper size command. While geographical distribution, and in some cases even line current, may be used to set the correct default size, this is not always reliable. Thus, a user with the different type of standard paper must frequently address a paper size error malfunction.

The change between letter size and legal size paper is the most common. Printed program material often need not be reformatted for the paper size change. If a program does not issue a paper size command (or the command is not inserted into the program's output document or file), the paper size command must be manually programmed to the printer. In some situations, particularly single user applications, the paper size is visibly apparent, and so it would be desirable if the printer automatically adjust for paper size error. Automatic adjustment would eliminate the need for the user to program a paper size command.

It would therefore be advantageous if the printer could be made to selectively accommodate the different page size, or could in some circumstances ignore or accommodate the unexpected page size.

SUMMARY OF THE INVENTION

According to the invention, sensed paper path malfunctions are treated in different manners in accordance with the anticipated nature of the sensed malfunction. This allows a paper processing machine such as a laser printer or other electrophotographic printer to continue operation with a minimum of user servicing and in a more reliable manner.

Sensed malfunctions occurring at an output of a pick mechanism are responded to by permitting the printer to continue operating in an attempt to clear paper in the paper path, whereas sensed malfunctions at locations downstream of the printer's imager are responded to by stopping the paper processing mechanism expeditiously. When the response is to continue operating, subsequent picks may be discontinued for a period of time long enough for the malfunction to have cleared.

This is preferably accomplished by permitting the paper processing mechanism to continue operating for a predetermined time period, after which the mechanism is stopped if a clearing of the malfunction or jam is not detected. The predetermined time period is made sufficient to permit sheets of paper which preceded the sheet related to the malfunction to clear the paper path so as not to complicate the malfunction.

By permitting the paper processing equipment to continue operating after malfunctions are detected at the output of a pick mechanism, the printer is able to clear some paper jams without operator intervention and is able to avoid causing further malfunctions as a result of stoppage of the printer with the preceding sheets in the paper path.

Conversely, stopping the paper processing mechanism in response to sensed malfunctions occurring downstream of the imager is also advantageous. This reduces the complications of paper path malfunctions which would result from continued operation of the printer with these malfunctions.

According to a preferred aspect of the invention, if a malfunction is detected as a paper jam upstream of the imager, the paper processing mechanism is permitted to continue for a predetermined time. The predetermined time is sufficient to permit some paper jams to self-clear, as well as to permit paper already in the paper path downstream of the jam to clear the fuser station. If a paper path malfunction is detected downstream of the imager, the paper processing mechanism is stopped in order that the suspected jam can be manually cleared.

If the jam is the result of a slow feed between the sensors upstream of the imager and a sensor downstream of the imager, the paper processing mechanism is permitted to continue for a predetermined time, after which the paper processing mechanism is stopped, unless the downstream sensor detects the paper prior to the paper processing mechanism being stopped. If the downstream sensor detects the paper prior to the paper processing mechanism being stopped, then the malfunction report is canceled and the paper processing mechanism is permitted to continue operating.

The invention provides unique responses to particular types of paper path malfunctions. When Pick-up Delay Jam or No-pick Jam happens, according to the invention, the response is to turn off the scanner and developer bias, then turn on the main motor and fuser for 25 seconds to clear the jam.

In order to avoid paper size jam reports due to incorrect paper size commands, the Pick Stationary jam detection is deleted. The letter size check timing of Delivery Stationary Jam detection is changed to match that of the longest commonly anticipated sheet (typically legal size paper). In the embodiment on which this invention is developed, this timing of the Delivery Stationary Jam detection is increased from 23.19 seconds to 26.38 seconds.

According to a further aspect of the invention, the printer's paper processing mechanism delays picking a second sheet in a multiple series of sequential pick operations, until sufficient time has passed for a predetermined maximum sheet size to be received by the paper processing mechanism. If the timing of the passage of the first sheet is appropriate for the paper size expected by the printer, the third and sequential pick operations in the series are effected at a timing appropriate for a the expected size of paper. If the timing of the first sheet is longer than appropriate for the paper size expected, then subsequent pick operations in the series are also delayed until sufficient time has passed for the longer sheets to be received by the printer. In this manner, the printer need not be set for the correct paper size to avoid an overlapping sheet feed jam, provided that the loaded paper supply is consistent for a given print job.

The delay sufficient to accommodate the longer sheet is effected only between the first sheet and second sheet in a multiple series of sequential pick operations, after which a shorter time delay appropriate to a narrow range of expected paper sizes is effected. If the first sheet is longer than expected, then the time delay is increased for the multiple series of sequential pick operations, but necessarily so if the subsequent sheets are also of the long size.

In the preferred embodiment, the paper size is adjusted without need for operator intervention; however, this aspect of the invention can be implemented by either requiring operator intervention after a paper size error is detected, or by automatically accommodating the paper size error, once detected. The time delay in picking the second sheet can be set to either the maximum size sheet accepted by the printer or the maximum commonly used size sheet, if these sizes are different.

In this manner, the possibility of a paper jam as a result of a paper size error is reduced with a minimum of time delay in the operation of the printer, and continued operation of the printer with the "wrong" size paper is permitted.

In accommodating paper size error, it is possible to require operator intervention upon detection of some paper size variations and yet permit continued operation without operator intervention upon detection of other paper size variations. In this manner, users of A-4 paper with equipment which defaults to 8½×11 letter size paper and vice-versa would not have to reset the paper size whenever a print job request does not have a paper size command. In a further refinement, the ignoring of selected paper size errors can be made to occur only when no paper size command is issued with the print job, but require operator intervention whenever a print job request includes a paper size command. In the preferred embodiment, however, the page error is ignored in both cases.

In implementing the invention, the number of sensors on a paper processing machine, such as a laser printer, can be reduced by the use of a single sensor to detect paper at multiple locations. The arms have flags which selectively interrupt a light path of a photosensor, thereby providing logical information regarding the presence of paper at different locations at different times. This information is combined with timing information and with information from other sensors, such as sensors located at an output station of the equipment. In one configuration, the sensing of the paper is accomplished by multiple arms which have flags. The flags on plural arms interrupt the light path of one photosensor, thereby allowing a single photosensor to be used to sense multiple conditions. This ability is enhanced by combining the logic output of the photosensor with timing information and with information from other sensors. This enables the equipment to distinguish between different sensed malfunctions.

A single photosensor may be used to sense the presence of paper in the paper supply and the presence of paper at the output of the D roller, and passage of the leading edge of the picked sheet. This may be accomplished by the use of a light path which intersects the positions to be sensed or by the use of mechanical arms. It is possible, particularly with a single photosensor upstream of the imager, to provide a plurality of arms which extend into sensed positions along the paper path and the arms have extensions or flags which are able to interrupt light passing through the photosensor. The interruption of the photosensor is interpreted in accordance with an anticipated timing of other functions of the paper processing equipment, such as the sensors located at the output station of the equipment, and the timing of a cycle of the equipment, along with external inputs such as paper sheet size. The preferred technique for resolving the timing information is by the use of a clock timer. Since the mechanical movement of the paper processing equipment also provides timing information, it is alternatively possible to time the information from the sensors by the use of sensed position of the paper processing mechanism. The single input sensor may be used in association with other data in order to provide paper processing equipment with an ability to separately indicate different types of malfunctions, such as a paper out condition.

While paper and paper processing is described herein, it is understood that the invention is useful with other types of sheet media and sheet media processing.

DETAILED DESCRIPTION OF THE PREFERRED EMBODIMENTS

Figure 1:
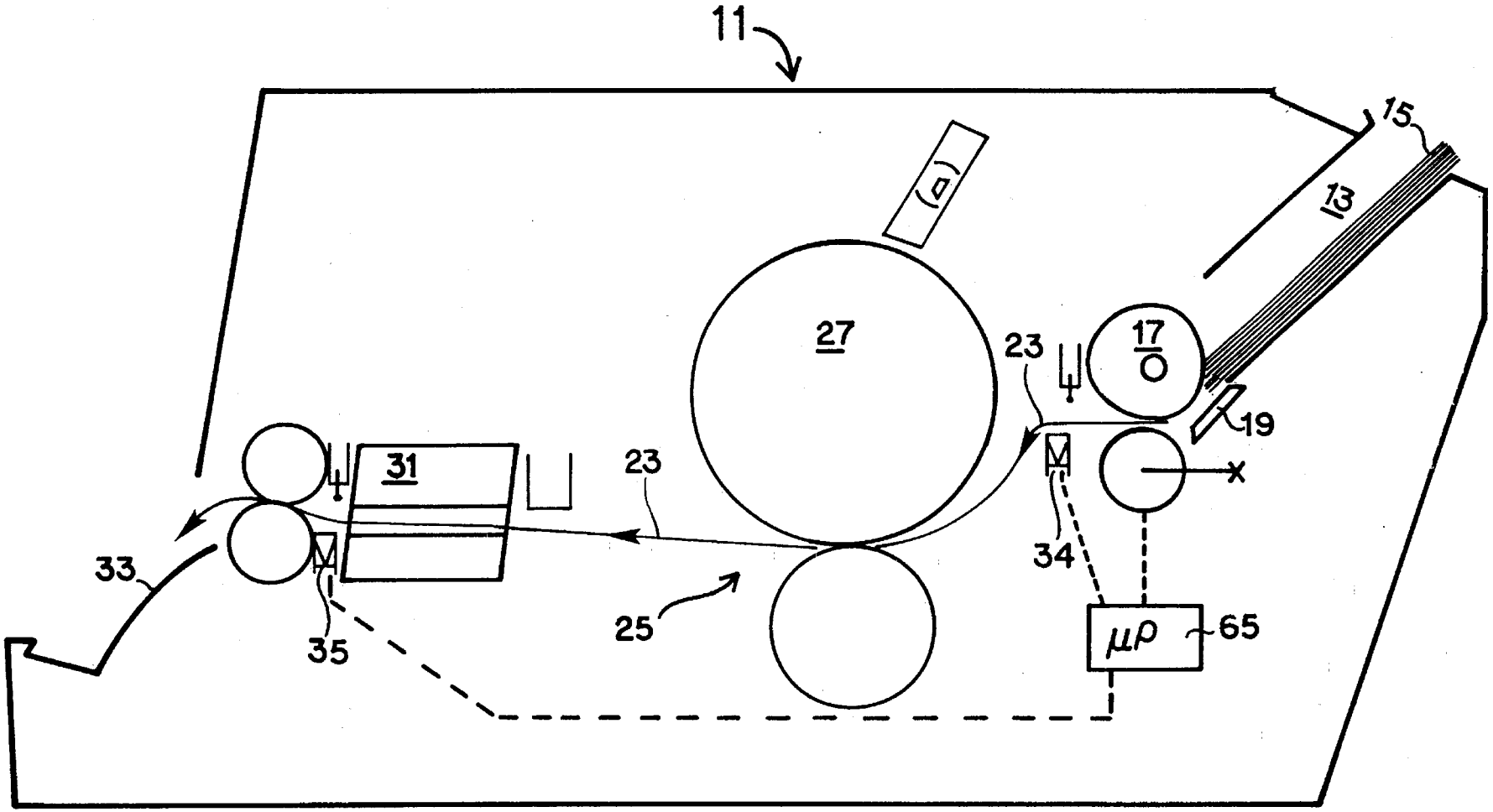
FIG. 1 shows a cross-sectional view of a paper path, including a paper supply station used in electrophotographic printing.

Referring to FIG. 1, a laser printer 11 is provided with a paper supply hopper 13, where one or more sheets of print media such as paper are retained as a stack of paper (or print media) 15. While a laser printer 11 is shown, the invention may be implemented in the form of other print media processing equipment, for example, other types of electrophotographic printers, ink jet printers, and folding and collating machines.

An eccentric roller 17, known as a D roller, is used to remove individual sheets of print media from the stack 15. The D roller 17 is aligned against a fixed pad, in the form of a stationary plate 19. The D roller 17 also has a higher coefficient of friction with respect to paper than the stationary plate 19, so that relative movement of the D roller 17 against the stationary plate 19 with paper between the parts (17 and 19) will result in the paper slipping past the stationary plate 19 and moving with the D roller 17. The stationary plate 19 is spring loaded against the D roller 17 and the coefficients of friction are such that only a single sheet of paper normally is moved by the rotation of the D roller 17, and is thereby moved past the stationary plate 19.

The removal of an individual sheet from the stack 15 is known as a pick, and is the technique which is preferably used to remove individual sheets of print media for purposes of further print media processing. It is understood that other techniques for effecting a pick are also consistent with this invention. In the laser printer application, the further print media processing consists of passing the sheet of print media along a paper path 23 to a developer station 25, which includes a photoreceptor 27 or other imager. In the preferred embodiment, the photoreceptor 27 is a cylindrical drum (shown), although it is contemplated that other configurations for the photoreceptor 27 are possible. The sheet is then further processed, usually passing a fuser station 31 and following paper path 23 to a discharge or output tray 33. Additional print media processing may be performed, such as providing a dryer station (used in the case of liquid toner, not shown) and a discharge handler such as a paper collator (not shown).

Regardless of the particular configuration of the paper processing equipment, many have in common a print media pick, followed by a primary series of print media processing operations. The primary series of print media processing operations in the laser printer of the preferred embodiment is the operations performed at the developer and fuser stations 27, 31. A developer input sensor 34 provides information regarding print media being supplied to the developer station 25 following a successful pick. If the single sheet of print media is picked, followed by a discharge (ejection) from the fuser station 31, a successful cycle can generally be assumed, at least as far as the primary print media processing operations. On the other hand, if the print media does not quite make it out of the primary series of print media processing operations, than a malfunction may be assumed. The sensing of print media discharge (ejection) from the fuser station 31 is accomplished by forward print media sensors, represented by fuser output sensor 35.

There are various configurations for the forward print media sensors (sensor 35), depending on the particular configuration of the print media processing equipment. In the preferred embodiment of this invention, sensor 35 senses that print media is discharged from the fuser station 31 in order to coordinate this information with the pick of the sheet. It is alternatively possible to use a sensor which may be located on the print media path before the fuser station 31, at any other location. For the purposes of this invention, any sensing of print media having proceeded beyond the sensing of a print media pick can be used, although the particular location of the forward sensor 35 affects the print media processing functions being sensed.

The invention seeks to exploit the relationship between the signals of developer input sensor 34 and fuser output sensor 35 in order to determine the most appropriate response to a sensed malfunction. The particular response is selected in order to determine a response of immediate stoppage, delayed stoppage to clear the print media path, or continued operation. In addition, the signals are used to automatically accommodate a print media size error caused by standard long ("legal") print media being loaded with the printer set to accept standard short ("letter" or "A-4) print media.

Response to malfunctions detected at the developer input sensor 34 is generally to continue operation of the printer for predetermined time periods until the jam either clears or corrects. If print media is not detected at developer input sensor 34 as a result of the developer input sensor 34 not indicating presence of print media at a predetermined time, as in a Pick-up Delay jam, the print mechanism is maintained in operation for a predetermined time period. If at the end of that time period the developer input sensor 34 senses the print media, the printer is permitted to continue its cycle. If the developer input sensor 34 does not sense the media, the printer is stopped. The time periods vary in accordance with speed of the paper processing equipment in the printer and as a result of empirical data obtained from testing the printer.

If the media does reach the developer input sensor 34 within the required time after the start of pick-up, but the trailing edge of the media does not pass, a Pick Stationary jam or Paper Size error is detected. The printer is not immediately stopped if a Pick Stationary jam or Paper Size error is detected, and so it is possible to distinguish between these malfunctions. In the case of a paper size error, these are assumed to occur as a result of legal size paper (21.59×35.56 cm) being used in place of 8½×11 letter (21.59×27.94 cm) or A-4 (21.0×29.7 cm). In the preferred embodiment, this error is ignored, by permitting the printer to adjust to the legal paper size.

This accommodation of a legal size paper error can be made to also accommodate other longer sizes such as B4 (25.7×36.4 cm), and oficio (21.59×33.02). This is an incidental benefit, since paper size errors from using sizes other than legal are not as common. Significantly, legal sheets are often interchangeably substituted for letter size sheets (or possibly A-4).

On sensing a paper size error, the printer is allowed to continue operation, thereby permitting the sheet to be printed and discharged (output). Feeding of the second sheet by the pick mechanism 17 is delayed sufficiently to accommodate legal size paper. This delays the printing of the second sheet by approximately 25%, but permits the printer to continue operating without paper overlap, should legal size paper be loaded into the paper supply hopper 13. The most common situation is that all sheets are the same size for a given print job. The printer does not delay picking subsequent sheets after the second sheet in a print job unless a paper size error is detected. If the paper size error is detected on the first sheet, the printer will self-program to the longer paper size, and thereby continue to delay picking subsequent sheets during a print job.

The delay in picking the second sheet is necessary because by the time the paper size error is detected, the pick mechanism 17 would have already picked the second sheet. Thus, even though the paper size error adjustment is made from sensing the first sheet, the first delay effected as a result of that sensing is for the third sheet in a print job.

A Pick Stationary jam is distinguished by the trailing edge of the paper not reaching the developer input sensor 34 within a given time. If this time is short enough, the malfunction is treated as a paper size error. If the time of sensing the trailing edge is longer than that commensurate with a paper size error, then further pick operations, except for the second sheet in a print job, are discontinued. The paper processing mechanism continues for a predetermined time period in an attempt to clear the jam. If the forward sensor 35 detects the sheet within the predetermined time period, the jam is considered to have cleared, and print operations are allowed to continue after the jammed sheets are discharged (ejected). If the forward sensor 35 fails to detect the sheet within the predetermined time period, the printer is stopped, and the jam must be manually cleared. The jam is assumed to require manual correction and in most cases the sheet either did not pass the developer station 27 or the fuser station 31. It is believed that the effect of the paper processing mechanism continuing to operate for the predetermined time period does not generally make the jam more difficult to manually clear, and in some cases makes the jam easier to clear.

If the delivery or forward sensor 35 does not sense the print media in the required time after the output of a Vertical Sync signal, a Delivery Stationary jam is detected. The response is to stop the printer, whereupon the jam may be manually cleared. This is also the response if the forward sensor 35 fails to detect the sheet after the predetermined time period after the sensing of a Pick Stationary jam.

In an Initial Residure jam, the developer input sensor 34 or forward sensor 35 detects or senses the media at a required time after power-on. This is an indication that the sensor is blocked, for example, by a sheet of print media in the print media path. The response is to stop the printer before a first pick operation.

The above information is typically combined with sensed information from other sensors, such as a paper supply hopper sensor (not shown) and print buffer information.

The coordination of information from the sensors 34, 35 is accomplished by switching. The switching may be accomplished by any of a number of means known to those skilled in the art of signal processing. A microprocessor 65 will be provided for the purposes of controlling the printer 11, and the microprocessor 65 is shown as controlling the information provided by error displays. While a microprocessor is shown, any type of convenient switching mechanism may be used to provide outputs in response to signals from the sensors 34, 35. The switching may also be provided through mechanical switching, and in the most basic sense, the switching may be accomplished manually, although this is considered to be impractical because of the limitations of human operators and because the purpose of the invention is to provide the information and a response of the printer from the output of the switching without further human intervention.

Figure 2:
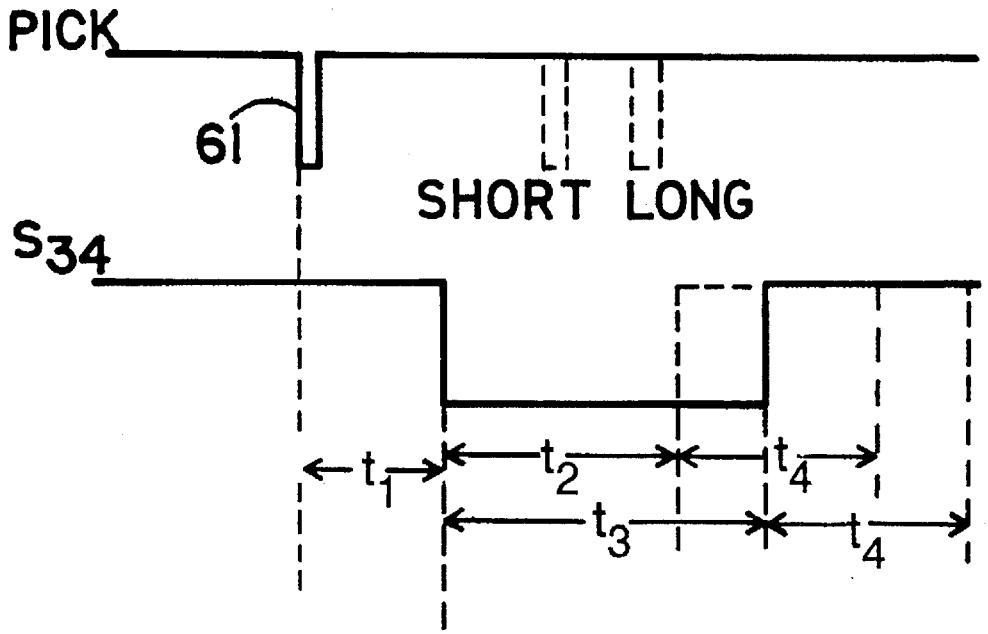
FIG. 2 is a timing diagram showing time delays required in accommodating different lengths of papers.

FIG. 2 is a timing diagram showing the time delays required in accommodating different lengths of paper. A signal to initiate a pick, depicted by pulse 61 on the top line, results in a pick operation by the D Roller 17, and therefore initiates movement of the paper. A first time delay, $t_1$, is the anticipated delay between initiation of a pick and detection of the leading edge of a sheet of paper or (or other print media) at the developer input sensor 34.

A second time delay $t_{set}$ corresponds to $t_2$ or $t_3$ shown in FIG. 2. $t_{set}$ is an anticipated time for the first sheet to clear before a subsequent sheet may be picked without overlapping or otherwise interfering with the first sheet. This is the time required for the developer input sensor 34 to stop sensing at the trailing edge of the sheet. As shown in FIG. 2, this is preferably started with the sensing of the leading edge of the sheet by the developer input sensor 34, but may begin from another time reference, such as pulse 61. If the sheets are a standard short length sheet, such as 8½×11 letter size, then $t_{set}=t_2$. If the sheets are a standard long length, such as 8½×14 legal size, then $t_{set}=t_3$. Therefore, accommodating the standard long length sheets would require that the cycle time between subsequent picks $t_{set}$ be extended by $t_3-t_2$. This is of course acceptable when the long length sheets are actually being printed, but would slow print cycling unnecessarily when the sheets being printed are standard short length, such as A-4 or 8½×11 letter size. In order to both accommodate the possibility of the printer being provided with paper of standard long length without a corresponding software command, the second sheet in a series of printed sheets is in fact delayed by $t_{set}=t_3$.

In this movement, the time between leading edge sensing of a sheet of paper at the developer input sensor 34 and the leading edge sensing of that sheet at the fuser output sensor 35 should be the same, regardless of sheet length. The time delay between leading edge sensing at the developer input sensor 34 and at the fuser output sensor 35 is $t_4$, In the preferred embodiment, the duration of $t_4$ would not normally change with a change in $t_{set}$.

In the preferred embodiment, the printer 11 moves paper along its paper path at a constant speed after a pick, and the descriptions of the time periods are based on the constant speed movement. Alternatively, if paper processing is accomplished at speeds which vary along the paper path, the time delays are adjusted accordingly.

Figure 3A:
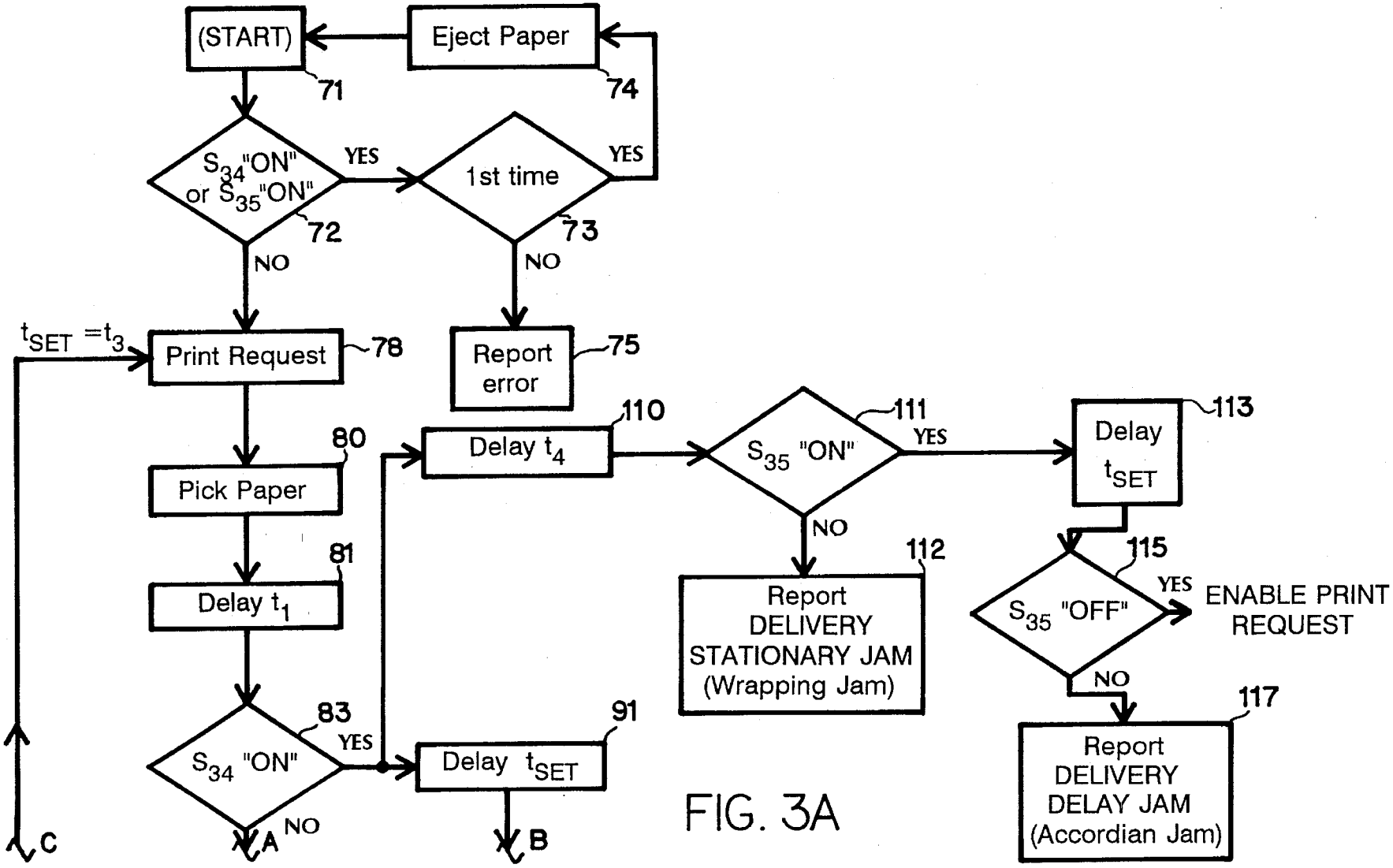
FIGS. 3A and 3B show a sample simplified logic flow pattern used with the sensor of FIG. 1.
Figure 3B:
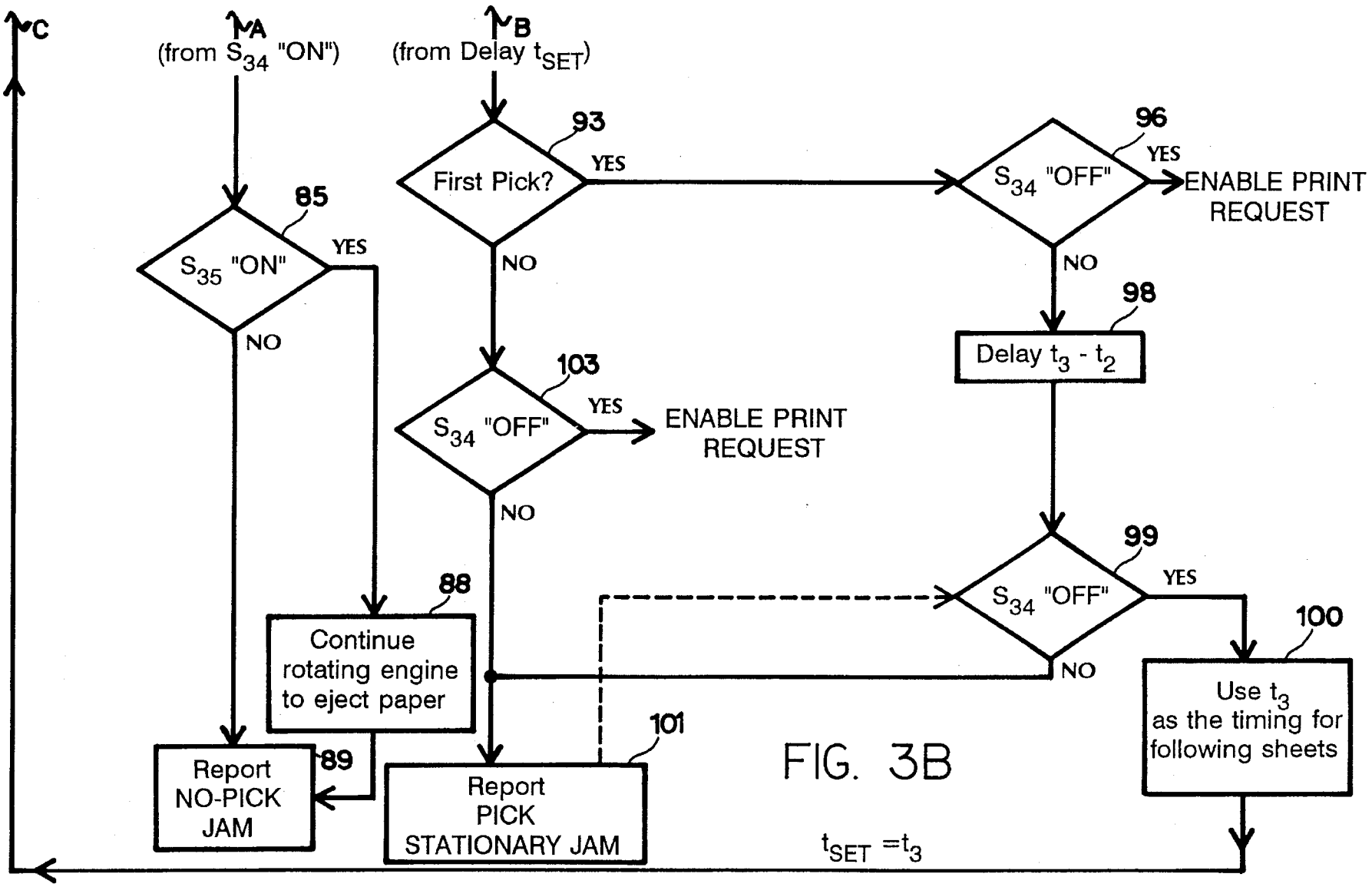

If the sheet does not properly move through the paper path, then the sensing would be affected accordingly. Referring to FIGS. 3A and 3B, the logic of misfeed sensing and paper size adjustment results in different responses, rather than a declared paper jam and associated equipment stoppage in all cases.

As shown in FIGS. 3, a start signal, represented by block 71, initiates sensing by the developer input and fuser output sensors 34, 35 indicated by $S_{34}$ and $S_{35}$, respectively. If either the developer input sensor 34 or the fuser output sensor 35 is indicating a sensed condition, represented by block 72, then a determination as to whether the sensed condition is occurring on a first time after "START" is made, as represented by block 73. If the sensed condition is a first occurrence, then an attempt is made to eject the paper, represented by block 74, followed by re-initiation of the process at block 71. If the sensed condition remains, then a paper path error is reported ("Initial Residure" malfunction), as represented by block 75. This determination is made the first time, meaning first occurrence of that logical test; not first period of time.

After both the developer input sensor 34 and the fuser output sensor 35 detect a clear paper path, a print request, represented by block 78 initiates further operation, starting with a paper pick, represented by block 80. After a time delay corresponding to $t_1$ (block 81 ), a determination of the sense status of the developer input sensor 34 is made, as represented by block 83. If the sense status (block 83) is that the sheet is present, then the successful pick is presumed and the operation is continued. If the sense status is that the sheet is not present, then a "no pick" malfunction is detected.

Upon detection of a "no pick" malfunction at block 83, a determination is made as to whether paper is sensed at the fuser output sensor 35, as represented by block 85. If paper is sensed at that location, it is usually because a sheet prior to the sheet which is the subject of the "no pick" malfunction is in the paper path. If the printer 11 stops at this point, the operator must remove that sheet. Since the printer 11 has stopped, the sheet at the fuser output sensor 35 will most likely be spoiled or jammed as a result of not fully clearing the fuser 31. If paper is sensed at the fuser output sensor 35, as represented by block 85, the response is to continue to drive the sheet through the printer 11 for sufficient time to eject the sheet. This is represented by block 88. This results in a successfully printed sheet, and eliminates the need for the operator to remove a sheet which is spoiled and coated with unfused toner. Whether or not the paper is sensed at the fuser output sensor 35 (block 85), a "no pick" malfunction is reported, as represented by block 89.

As represented by block 91, detection of a successful pick by developer input sensor 34, and represented by block 83 initiates the waiting of a time delay $t_{set}$, which anticipates a page length. The time delay $t_{set}$ is initially $t_2$ ($t_{set}=t_2$). If after $t_{set}$, the developer input sensor 34 is off, then the trailing edge of the sheet has passed sensor 34 and the value ($t_{set}=t_2$) is presumed to be correct. On the other hand, if the developer input 34 is still sensing paper after $t_{set}$, then the value $t_{set}=t_2$ would be incorrect.

A determination is made as to whether the subject cycle is the first sheet in a series of print requests (first page in a print command or print job). This determination is shown by block 93. If the cycle is the first sheet, then a determination as to whether the sheet has passed the developer input sensor 34 is made, as shown by block 96. If the sheet has passed the developer input sensor 34, the value $t_{set}=t_2$ is correct for that sheet, and no adjustment of $t_{set}$ is effected, and a subsequent print request in the print series or command is enabled.

On the other hand, if the determination, represented by block 96 is that the sheet has not passed the developer input sensor 34, then a delay is effected equal to the time difference of $t_3-t_2$, represented by block 98. After the delay equal to the difference of $t_3-t_2$ (block 98), the developer input sensor 34 is again checked (block 99). If at that time, the sensor indicates no paper, then the sheet has passed, but has taken longer than the time delay $t_2$. The value $t_{set}=t_2$ is therefore presumed incorrect and is changed to $t_{set}=t_3$, and further print requests use that setting. This adjustment of $t_{set}$ from $t_2$ to $t_3$ is represented by block 100.

On the other hand, if at that time, the developer input sensor 34 continues to indicate paper, then the sheet has not passed, and a "Pick Stationary jam" malfunction is reported, as represented by block 101.

If a determination that the subject cycle is not the first sheet in a series of print requests, represented block 93, then a determination as to whether the sheet has passed the developer input sensor 34 is made. This is represented by block 103. As was the case represented by block 96, the response to the sheet having passed the developer input sensor 34 to enable a subsequent print request in the print series or command. If the determination, represented by block 103 is that the sheet has not passed the developer input sensor 34, then no attempt is made to adjust $t_{set}$, which is at either $t_2$ or $t_3$. A "Pick Stationary" malfunction is reported.

In the preferred embodiment, the response to a "Pick Stationary" malfunction is to indicate a paper feed malfunction and stop the paper feed mechanism. After the operator clears the malfunction, the printer 11 is restarted (block 71 ). If the sheet is the first pick, the next pick would also be considered to be the first sheet in a series of print requests, as determined at block 93. The sequence of testing sheet length and adjusting $t_{set}$ (blocks 98, 99, and 100) would then be performed. It is possible to treat any sheet after a "Pick Stationary" malfunction report as a first sheet (block 93), but this would be advantageous primarily if it is anticipated that the cause of the "Pick Stationary" malfunction is a sheet size change.

It is alternately possible to attempt to eject the sheet, followed by stoppage of the paper feed mechanism if the sheet does not clear the sensors 34, 35. Preferably, if a "Pick Stationary" jam is reported on the first print request in the series or command, the value $t_{set}=t_3$ would be used for the remainder of the series.

Detection of a successful pick by developer input sensor 34, and represented by block 83 also initiates the waiting of a time delay $t_4$, as represented by block 110. After time delay $t_4$, a determination is made as to whether the fuser output sensor 35 senses paper, as represented by block 111. If not, then a "Delivery Stationary jam" is reported (block 112). If the fuser output sensor 35 senses paper, the time delay $t_{set}$ is used to determine whether the paper passes the sensor 35 according to the sheet length determined by $t_{set}$. This is shown at block 113. As represented by block 115, if the paper is cleared, the printer 11 is permitted to continue. If the paper has not cleared the fuser output sensor 35 at the appropriate time ($t_4+t_{set}$), then a "delivery delay jam" is reported (block 117).

The above logic permits the detection of variable sheet sizes. It further allows the printer to make sequential picks for shorter size paper more rapidly. At the same time, the response to various reported jams and malfunctions is made appropriate to the particular type of jam in accordance with timing and location of the sensing of the malfunction, rather than merely terminate operation. The detection of variable sheet sizes is also used to permit a quick response to output jams involving short sheets, despite the ability to accommodate longer sheets without the cognizant programming command for the longer sheets. This, combined with providing an appropriate response in accordance with the type of malfunction sensed further reduces a requirement for operator intervention to clear malfunctions. The invention further has the advantage of reducing paper waste in the event of a malfunction by permitting the printer 11 to continue processing unaffected sheets.

In reading the flow chart of FIGS. 3, one should note that sensor 45 provides a sensed logic level, shown as "yes," to indicate presence of paper. It is also possible to configure sensors to indicate a high logic level in the absence of print media. In that case, the logic flow is modified accordingly. It is of course to substantially vary from the particular logic sequence shown in FIGS. 3 and yet accomplish similar results.

There are various ways of accomplishing the various functions described. It is possible to use the inventive sensor system in sheet media processing equipment other than printers, and in equipment which can be adapted to accept other forms of media. In such an arrangement, appropriate adaptations would be made to the sensing of the media. It is also possible to provide different combinations of sensors, such as multiple sensors, power consumption sensors, as well as mechanical movement devices and timers. It is also possible to effect a delay ($t_3$–$t_2$) beyond the second sheet in appropriate circumstances. This would accommodate different configurations of a pick mechanism, as well as a possibility that a first sheet may be different in size from subsequent sheets. It is therefore anticipated that the invention should be limited in scope only by the claims.

What is claimed is:

1. Method of operating sheet media processing apparatus in which sheet media is transported from a sheet media supply through at least a primary series of sheet media processing operations by a sheet media processing mechanism, the method comprising:

a. providing a pick sensor for determining the presence of sheet media which has been removed from the sheet media supply by a pick mechanism;

b. providing a forward position sensor to detect the presence of said sheet of sheet media at an end of said primary series of sheet media handing operations;

c. initiating a pick of a sheet by the pick mechanism from the sheet media supply;

d. waiting for a first time period and then determining if the pick sensor has sensed said sheet media in a first instance;

e. determining an anticipated time of passage of a predetermined long size sheet, said anticipated time of passage corresponding to the predetermined long size sheet moving past at least one sensor after a pick operation; and f. waiting for a time period corresponding to said anticipated time of passage of said predetermined long size sheet and then determining if the pick sensor continues to sense said sheet media at the pick sensor in a second instance, and if the pick sensor continues to sense said sheet media in the second instance, establishing the time period corresponding to an anticipated time of passage of said sheet to be an anticipated time of passage of a predetermined long size sheet.

2. Method of operating sheet media processing apparatus as described in claim 1, further comprising waiting for a further time period in the case of the pick sensor has continued to sense sheet media after said anticipated time of passage of said predetermined long size sheet, and then determining if the pick sensor continues to sense said sheet media at the sensor in a third instance, and if the pick sensor continues to sense said sheet media in the third instance, respond with a predetermined response to a pick stationary malfunction.

3. Method of operating sheet media processing apparatus as described in claim 2, further comprising:

a. locating the forward position sensor so as to detect said sheet after said primary series of sheet media processing operations have commenced;

b. waiting for a time period corresponding to the delay time from a successful pick to said sheet media reaching said forward position sensor after supply by the pick mechanism;

c. then determining if the forward position sensor has sensed said sheet media, and if the forward position sensor fails to sense said sheet media, respond with a predetermined response to a delivery stationary jam;

d. waiting for said time period corresponding to an anticipated time of passage of said predetermined long size sheet; and e. then determining if the forward position sensor continues to sense said sheet media, and if the forward position sensor continues to sense said sheet media, respond with a predetermined response to a delivery delay malfunction, whereby:

the steps of determining if the pick sensor continues to sense said sheet media at the pick sensor in the second instance and establishing the time period corresponding to the anticipated time of passage of the predetermined long size sheet past the pick sensor if the pick sensor continues to sense said sheet media in the second instance result, after said step of establishing the first time period, in said predetermined response to the delivery delay malfunction being effected according to the size of said sheet as established in said step of establishing the first time period, while not resulting in said predetermined response in the case of provision of said predetermined long size sheet being provided, and without a requirement to provide further data to indicate said provision of said predetermined long size sheet.

4. Method of operating sheet media processing apparatus as described in claim 3, wherein said step of waiting for a time period corresponding to the delay time from a successful pick to said sheet media reaching said forward position sensor after supply by the pick mechanism comprises waiting for a time period from the pick sensor having sensed said sheet media.

5. Method of operating sheet media processing apparatus as described in claim 3, wherein said step of waiting for a time period corresponding to the delay time from a successful pick to said sheet media reaching said forward position sensor after supply by the pick mechanism comprises waiting for a time period from initiation of said pick.

6. Method of operating sheet media processing apparatus as described in claim 2, further comprising:

a. providing a first response to a first type of malfunction in a sheet media path of the sheet media processing apparatus, and providing a second response responding to other types of malfunctions in the sheet media path, thereby permitting the sheet media processing to attempt to clear malfunctions in the sheet media path;

b. providing a malfunction response to said forward position sensor continuing to sense said sheet media beyond a time period corresponding to the anticipated time of passage of the sheet media past the forward position sensor; and c. using said step establishing the time period corresponding to the anticipated time of passage of the predetermined long size sheet if the pick sensor continues to sense said sheet media in the second instance to provide said response to said forward position sensor.

7. Method of operating sheet media processing apparatus as described in claim 1, further comprising:

a. prior to the step of initiating said pick, responding to the pick sensor and the forward position sensor in order to determine if sheet media is in the sheet media processing apparatus downstream of the pick mechanism and responding in the case of detection of said sheet media downstream of the pick mechanism; and b. said response to at least one form of detection of sheet media downstream including an attempted ejection of said sheet media.

8. Method of operating sheet media processing apparatus as described in claim 1, further comprising:

after determining if the pick sensor has sensed said sheet media, determining if the forward position sensor has sensed said sheet media, and if the pick sensor fails to sense said sheet media and the forward position sensor fails to sense sheet media, respond with a first predetermined response to a no-pick jam, and if the pick sensor fails to sense said sheet media and the forward position sensor senses sheet media, respond with a second predetermined response to a no-pick jam, the second predetermined response including attempting to eject the sheet media sensed by the forward position sensor.

9. Method of operating sheet media processing apparatus in which sheet media is transported from a sheet media supply through at least a primary series of sheet media processing operations by a sheet media processing mechanism, the sheet media processing mechanism including a pick sensor for determining the presence of sheet media which has been removed from the sheet media supply by a pick mechanism, in which the malfunctions in a sheet media path are sensed, the method comprising:

a. using said a pick sensor for determining the presence of sheet media which has been removed from the sheet media supply by a pick mechanism in a pick operation;

b. providing a forward position sensor to detect the presence of said sheet of sheet media at an end of said primary series of sheet media handing operations, and locating said sensor so as to detect said sheet after said primary series of sheet media processing operations have commenced;

c. waiting for a time period corresponding to delay time in sensing sheet media by the pick sensor after initiation of said pick operation;

d. then determining if the pick sensor has sensed said sheet media; and e. determining if the forward position sensor has sensed said sheet media, and if the pick sensor fails to sense said sheet media and the forward position sensor fails to sense sheet media, respond with a first predetermined response, and if the pick sensor fails to sense said sheet media and the forward position sensor senses sheet media, respond with a second predetermined response.

10. Method of operating sheet media processing apparatus as described in claim 9, further wherein the second predetermined response including attempting to eject the sheet media sensed by the forward position sensor.

11. Method of operating sheet media processing apparatus as described in claim 9, further wherein ambiguities in possible causes of malfunctions which are detected at different locations in the sheet media path are resolved by the timing of detection by said sensors.

12. Sheet media processing apparatus in which sheet media is transported from a sheet media supply through at least a primary series of sheet media processing operations, in which the sheet media processing apparatus senses malfunctions in a sheet media path, the apparatus comprising:

a. a sheet media processing mechanism for transporting the sheet media from the sheet media supply hopper through said primary series of sheet media processing operations;

b. a pick mechanism for removing said sheet of sheet media from the sheet media supply, removing said sheet from the sheet media supply, and providing said sheet at an output of the pick mechanism;

c. a sensor for determining the presence of sheet media at the output of the pick mechanism;

d. a forward position sensor to detect the presence of said sheet of sheet media after said primary series of sheet media handing operations, the forward position sensor being located so as to detect said sheet after said primary series of sheet media processing operations have commenced; and e. switching means responsive to the sensor for determining the presence of sheet media at the output of the pick mechanism and the forward position sensor, the switching means controlling the sheet media processing operations, wherein the switching means responds to a first type of malfunction in a sheet media path of the sheet media processing apparatus in a first manner, and responds to other types of malfunctions in the sheet media path in a different manner, thereby permitting the sheet media processing apparatus to attempt to clear malfunctions in the sheet media path.

13. Sheet media processing apparatus as described in claim 12, wherein, in a given series of sheet media processing operations:

a. said switching means controls the pick mechanism so as to pick a second sheet of sheet media after a first predetermined time period which is sufficient to permit passage of a predetermined sheet media length without the second sheet overlapping a first sheet;

b. said switching means controls the pick mechanism so as to pick sheets subsequent to a predetermined sheet in the series after a second time period after each preceding sheet, the second time period selected as initially shorter in duration than the first time period; and c. said switching means detecting a length of at least one sheet of the sheet media in accordance with a time of passage of said sheet past at least one of said sensors; and d. said switching means responding to a detected length of at least one sheet of sheet media by changing the subsequent time period, thereby accommodating different lengths of sheet media while reducing a process time for multiple sequential sheet processing operations in said given series.

* * * * *